US006267688B1

(12) United States Patent
Morelli, Sr.

(10) Patent No.: US 6,267,688 B1
(45) Date of Patent: Jul. 31, 2001

(54) APPARATUS AND METHOD FOR THE CREATION AND COVERING OF HOLES ON GOLF GREENS AND THE LIKE

(76) Inventor: Alan J. Morelli, Sr., P.O. Box 979, Lake Havasu City, AZ (US) 86405

( * ) Notice: Subject to any disclaimer, the term of this patent is extended or adjusted under 35 U.S.C. 154(b) by 0 days.

(21) Appl. No.: 09/372,131

(22) Filed: Aug. 11, 1999

(51) Int. Cl.[7] ..... A63B 57/00
(52) U.S. Cl. ..... 473/179; 473/175
(58) Field of Search ..... 473/175, 176, 473/177, 178, 179, 405, 492, 174; 52/298

(56) References Cited

U.S. PATENT DOCUMENTS

| | | | | |
|---|---|---|---|---|
| 947,819 | * | 2/1910 | Hinckley | 473/176 |
| 1,041,081 | * | 10/1912 | Hinckley | 473/176 |
| 3,612,287 | * | 10/1971 | Maltese | 52/298 |
| 3,772,841 | * | 11/1973 | Barak et al. | 473/176 |
| 3,870,301 | * | 3/1975 | Brisendine | 473/179 |
| 5,382,018 | * | 1/1995 | Browne | 473/175 |

FOREIGN PATENT DOCUMENTS

| | | | | |
|---|---|---|---|---|
| 2030219 | * | 4/1993 | (AU) | 273/34 B |
| 238383 | * | 8/1925 | (GB) | 273/34 B |

OTHER PUBLICATIONS

U.S. Patent No. 5,857,919* issued in the name of Hoyt et al. on Jan. 12, 1999.
U.S. Patent No. 5,776,004* issued in the name of Wilson on Jul. 7, 1998.
U.S. Patent No. 5,524,891* issued in the name of Owen, Jr. on et al. Jun. 11, 1996.
U.S. Patent No. 5,078,394** issued in the name of Kretz on Jan. 7, 1992.
U.S. Patent No. 4,280,698** issued in the name of Troiano.
U.S. Patent No. 5,427,371* issued in the name of Huston et al. on Jan. 27, 1995.
U.S. Patent No. 5,415,397* issued in the name of Van Holt, Jr. on May 16, 1998.
U.S. Patent No. 1,612,291* issued in the name of Jackson on Dec. 28, 1926.

* cited by examiner

*Primary Examiner*—Mark S. Graham
(74) *Attorney, Agent, or Firm*—John D. Gugliotta

(57) ABSTRACT

An apparatus and method for the creation and covering of holes on golf greens and the like is disclosed, designed as a system and method by which holes in natural or synthetic playing surfaces can be created and then covered when not in use. The present invention comprises an hollow, cylindrical insert. One end of the insert is open. Holes are located on the other end to allow water to pass out of the insert. The insert is placed permanently into the ground at a location where a hole is desired by pressing the insert into a hole created by a standard auger tool. A pointed protrusion keeps the insert from rotating once the insert is placed in the ground. The insert is designed to be used as a golf cup on a green or with stanchion supports for other sporting equipment that may be used with soccer, baseball, football, and the like. A flat, circular cap screws into the top of the insert. The cap has a covering of synthetic grass which matches the surrounding surface area. The cap is screwed onto and off of the insert via cap rotation means.

10 Claims, 6 Drawing Sheets

APPARATUS AND METHOD FOR THE CREATION AND COVERING OF HOLES ON GOLF GREENS AND THE LIKE

RELATED APPLICATIONS AND DISCLOSURES

The present invention was first disclosed in the Disclosure Document filed on Mar. 1, 1999. There have been no previously filed, nor any co-pending applications, anywhere in the world.

BACKGROUND OF THE INVENTION

1. Field of the Invention

The present invention relates generally to golf course equipment, and, more particularly, to an apparatus and method for the creation and covering of holes on golf greens and the like.

2. Description of the Related Art

Having attained the status as one of the leading leisure time outdoor sporting activities in America today, the game of golf enlists participants of all ages. In hitting the links, one not only enjoys the satisfaction of getting out in the fresh air and playing the game, they also gain the benefit of exercise in swinging the clubs and walking what can amount to several miles.

Golf course managers, trying to generate new business, continually trying to attract new members to their courses. One way to accommodate new and differently skilled golfers is to provide differently located holes on the greens for various levels of skill.

However, multiple holes pose problems, not the least of which is the damage to the greens and the time to auger out and place the new cups. Once a hole is placed, it is there until it is filled. Other sports also require holes in the playing surfaces such as for baseball backstops, soccer goals, goal posts and the like. Again, once these holes are placed, they are difficult to quickly fill. Accordingly, there is a need for a means by which one can provide for permanent holes on playing surfaces for the use of stanchion mounted equipment or the placement of multiple golf cups on greens that can be covered when not in use.

In the related art, several devices are disclosed that describe a putting practice device which decreases the diameter of the hole. These include U.S. Pat. No. 5,857,919, issued in the name of Hoyt et al., U.S. Pat. No. 5,776,004, issued in the name of Wilson, and U.S. Pat. No. 5,524,891, issued in the name of Owen, Jr. et al.

Several patents describe a golf cup cover and putting aid including a small central opening large enough for a golf ball to enter. These include U.S. Pat. No. 5,078,394, issued in the name of Kretz, and U.S. Pat. No. 4,280,698, issued in the name of Troiano.

U.S. Pat. No. 5,427,371, issued in the name of Huston et al., discloses an indoor golf hole, installation method, and cover plate to cover the hole when not in use.

U.S. Pat. No. 5,415,397, issued in the name of Van Holt, Jr., describes a device for reducing the diameter of a golf hole and simultaneously increasing its visibility.

U.S. Pat. No. 1,612,291, issued in the name of Jackson, discloses an indoor golf game with a metal plug to cover the golf hole when not in use.

A search of the prior art did not disclose any patents that anticipate directly many features of the instant invention. Consequently, a need has been felt for providing an apparatus and method which overcomes the problems cited above.

SUMMARY OF THE INVENTION

It is therefore an object of the present invention to provide an improved apparatus and method for the creation and covering of holes on golf greens and the like that provides for permanent holes on playing surfaces for the use of stanchion mounted equipment or the placement of multiple golf cups on greens that can be covered when not in use.

Briefly described according to one embodiment of the present invention, an apparatus and method for the creation and covering of holes on golf greens and the like is disclosed, designed as a system and method by which holes in natural or synthetic playing surfaces can be created and then covered when not in use.

The present invention comprises an insert, of a generally linearly elongated, cylindrical, hollow configuration. One end of the insert is open. Insert holes are located on the other end to allow water to pass out of the insert.

It is envisioned that the insert is placed permanently into the ground at a location where a hole is desired.

A pointed protrusion, being of a generally flat, rectangular configuration, with a knife edge, prohibits the insert from rotating once the insert is placed in the ground.

The insert is designed to be used as a golf cup on a green or with stanchion supports for other sporting equipment that may be used with soccer, baseball, football, and the like. As such, the depth and radial diameter of the insert may vary depending on its application.

It is envisioned that a flat, circular cap screws into the top of the insert.

The cap has a covering of synthetic grass which matches the surrounding surface area. The thickness and density of the synthetic grass is designed to mimic the surrounding surface.

The cap is screwed onto and off of the insert via cap rotation means. As the cap is screwed on and off the insert, the pointed protrusion on the insert keeps the insert from rotating.

It is another object of the present invention to provide a device that allows for multiple holes on one golf green.

It is another object of the present invention to provide a device that quickly covers and uncover the holes used in golf or to support sporting equipment.

It is another object of the present invention to provide an insert that will not rotate over time or when the cap is removed or placed on the insert.

It is another object of the present invention to provide a device that can be used for virtually every sport.

It is another object of the present invention to provide a device that can be for highway safety purposes by securing reflective signs, stanchions, etc.

Other objects of the present invention include providing an apparatus that is strong, durable and light weight.

| DESCRIPTIVE KEY | |
|---|---|
| 10 | apparatus and method for the creation and covering of holes on golf greens and the like |
| 20 | insert |
| 25 | insert hole |
| 27 | auger tool |
| 30 | pointed protrusion |

-continued

| DESCRIPTIVE KEY | |
|---|---|
| 40 | golf green |
| 50 | sporting equipment |
| 60 | cap |
| 70 | external threads |
| 80 | internal threads |
| 90 | covering |
| 95 | synthetic grass |
| 100 | cap rotation means |
| 105 | cap hole |
| 107 | T-wrench |

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the FIGS. 1 through 10.

1. Detailed Description of the Figures

Figure 1:
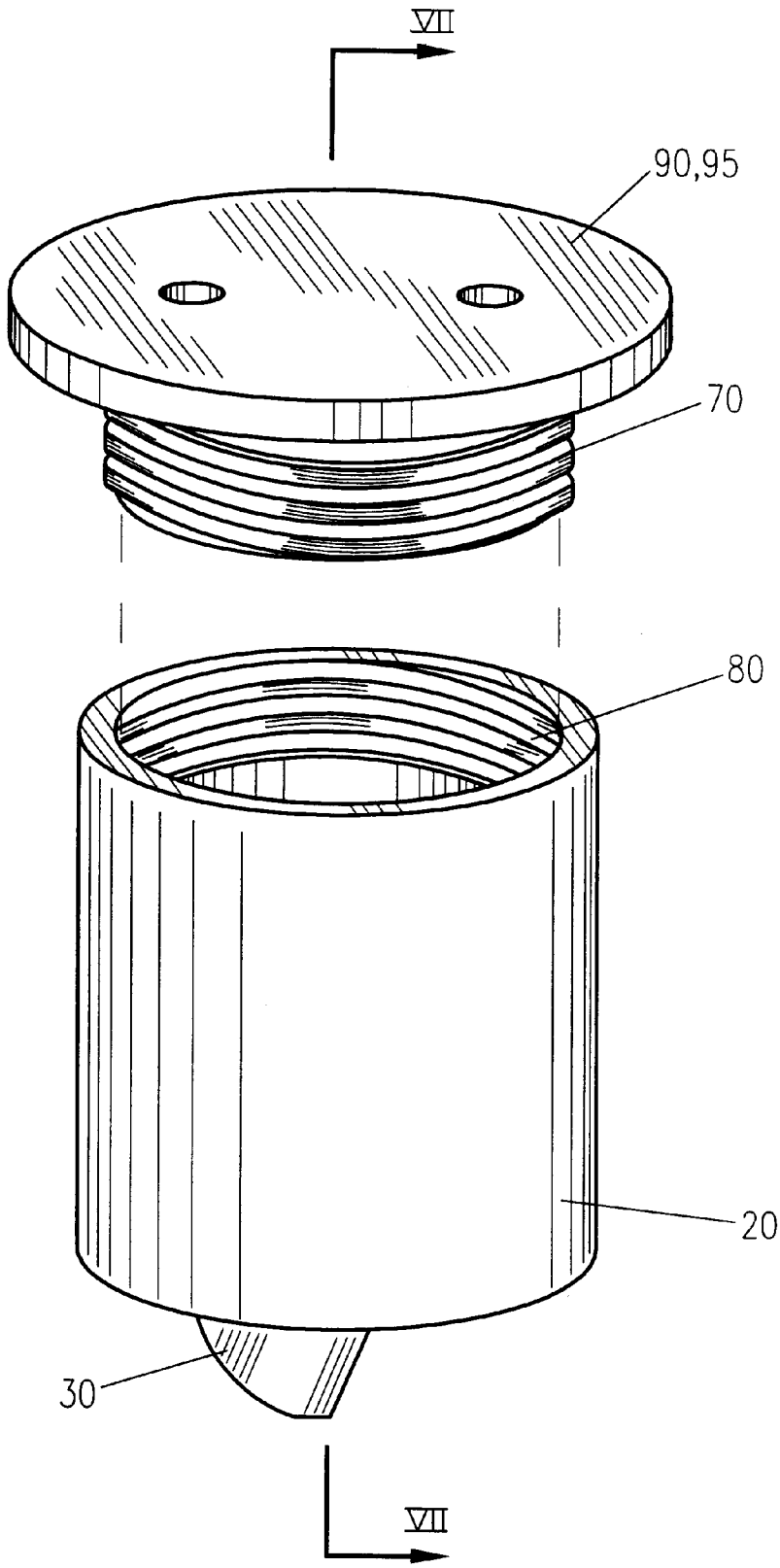
FIG. 1 is an exploded view of the preferred embodiment of apparatus and method for the creation and covering of holes on golf greens and the like 10.

Referring now to FIG. 1, an apparatus for the creation and covering of holes on golf greens 10 is shown, according to the present invention, designed as a system and method by which holes in natural or synthetic playing surfaces can be created and then covered when not in use.

Figure 2:
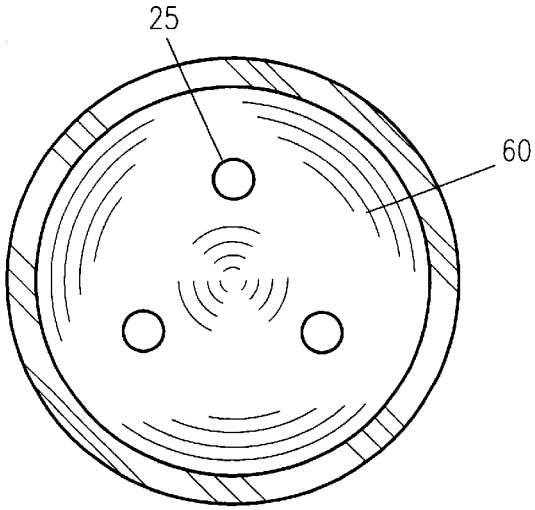
FIG. 2 is a top view of the insert.
Figure 3:
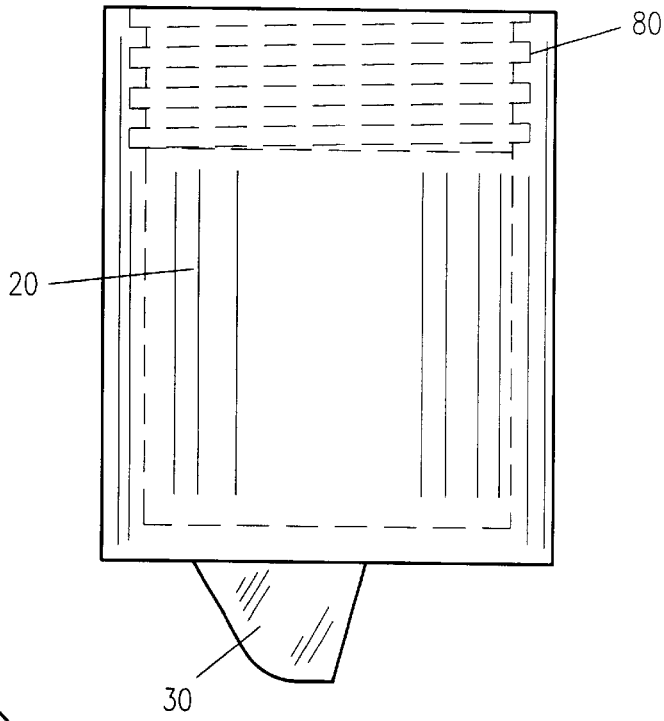
FIG. 3 is a side view thereof.

Referring now to FIGS. 1 through 3, the present invention comprises an insert 20, of a generally linearly elongated, cylindrical, hollow configuration. One end of the insert 20 is open. A plurality of insert holes 25 are located on the other end to allow water to pass out of the insert 20. The insert 20 is placed in the ground after a standard auger tool 27 (not shown) creates a hole for the insert 20.

It is envisioned that the insert 20 is constructed of a material selected from the group comprising rubber, plastic and metal.

It is envisioned that the insert 20 is placed permanently into the ground at a location where a hole is desired.

Figure 4:
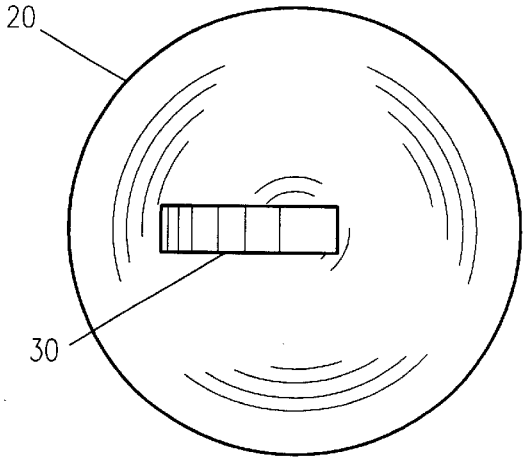
FIG. 4 is a bottom view thereof.

Referring now to FIGS. 1, 3 and 4, at least one pointed protrusion 30, being of a generally flat, rectangular configuration, with a knife edge, prohibits the insert 20 from rotating once the insert 20 is placed in the ground. For purposes of disclosure, the pointed protrusion 30 is located on the bottom of the insert 20.

The insert 20 is designed to be used as a golf cup on a golf green 40 (not shown) or with stanchion supports for other sporting equipment 50 (not shown) that may be used with soccer, baseball, football, and the like.

Figure 5:
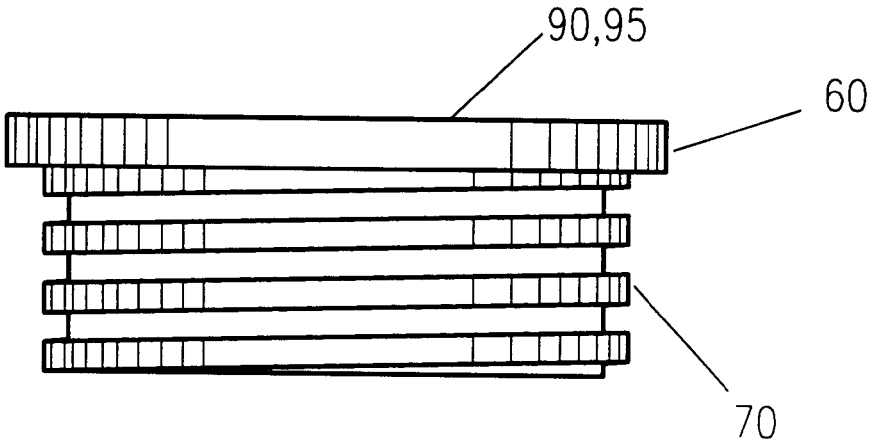
FIG. 5 is a side view of the cap.
Figure 6:
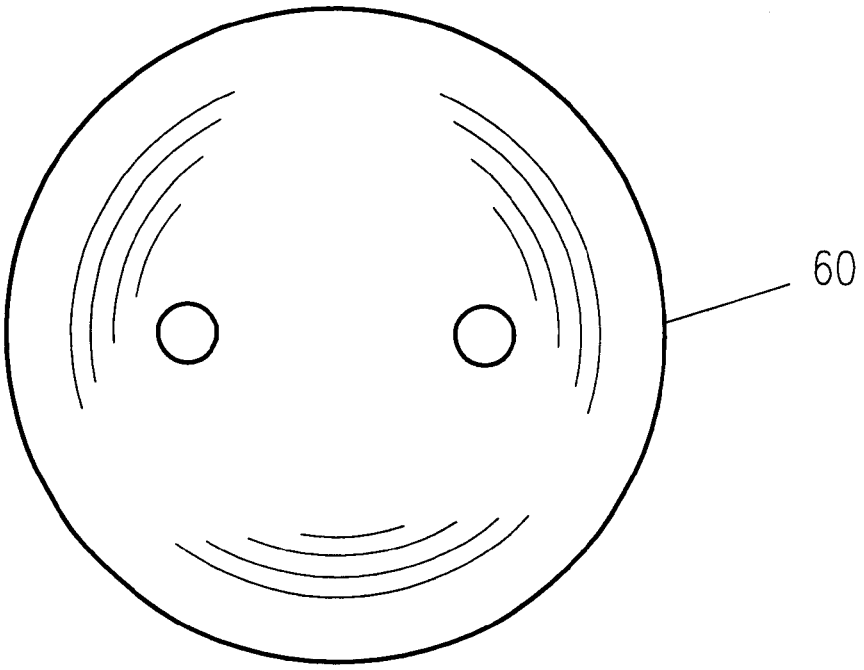
FIG. 6 is a top view thereof.

Referring now to FIGS. 1,5 and 6, it is envisioned that a cap 60 of a generally flat, round configuration releasably secures to the top portion of the insert 20.

Figure 7:
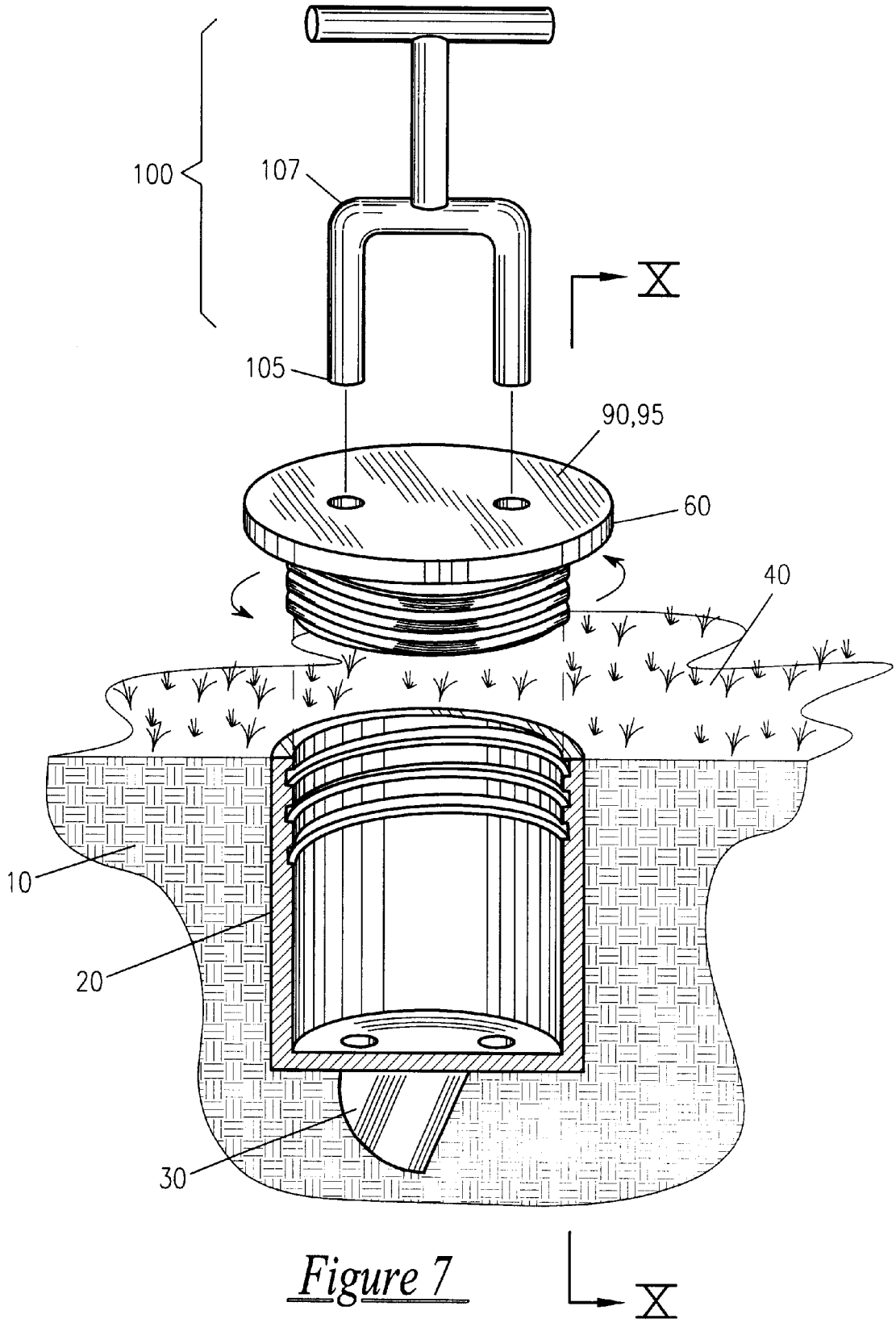
FIG. 7 is an exploded, cross-sectional view cut along line VII—VII of FIG. 1, showing the present invention in place in the ground.

Referring now to FIGS. 1 and 7, external threads 70 located on the cap's 60 exterior circumferential surface, mate with internal threads 80 located on the upper, interior circumferential surface of the insert 20, near the open end of the insert 20. As such, the cap 60 can be removed for use as with stanchions and sporting equipment 50 (not shown) or on a golf green 40.

It is envisioned that the cap 60 is constructed of a material selected from the group comprising rubber, plastic and metal.

Referring now to FIGS. 1, 6 and 7, it is envisioned that the cap 60 is provided with a covering 90 which matches the surrounding surface area. For most applications, the covering will be synthetic grass 95. The thickness and density of the synthetic grass 95 is designed to mimic the surrounding surface. When the cap 60 is fully screwed onto and tightened onto the insert 20, the synthetic grass 95 will form a level surface with the surrounding grass. If the present invention is used around a surface other than grass, the covering 90 may be other than synthetic grass 95 to match the surrounding surface.

Referring now to FIG. 7, the cap 60 is screwed onto and off of the insert 20 via cap rotation means 100. For purposes of disclosure, the cap rotation means 100 is depicted as two cap holes 105 located on the top of the cap 60 designed and located for use with a "T-wrench." 107 As the cap 60 is screwed on and off the insert 20, the pointed protrusion 30 on the insert 20 keeps the insert 20 from rotating.

It is envisioned that other styles and configurations of the present invention can be easily incorporated into the teachings of the present invention, and only one particular configuration shall be shown and described for purposes of clarity and disclosure and not by way of limitation of scope.

2. Operation of the Preferred Embodiment

To use the present invention, the operator decides where the insert 20 is desired. The auger tool 27 is used to dig the hole. The insert 20 is then placed in the ground, with the pointed protrusion 30 being countersunk, thereby keeping the insert 20 from rotating.

Figure 8:
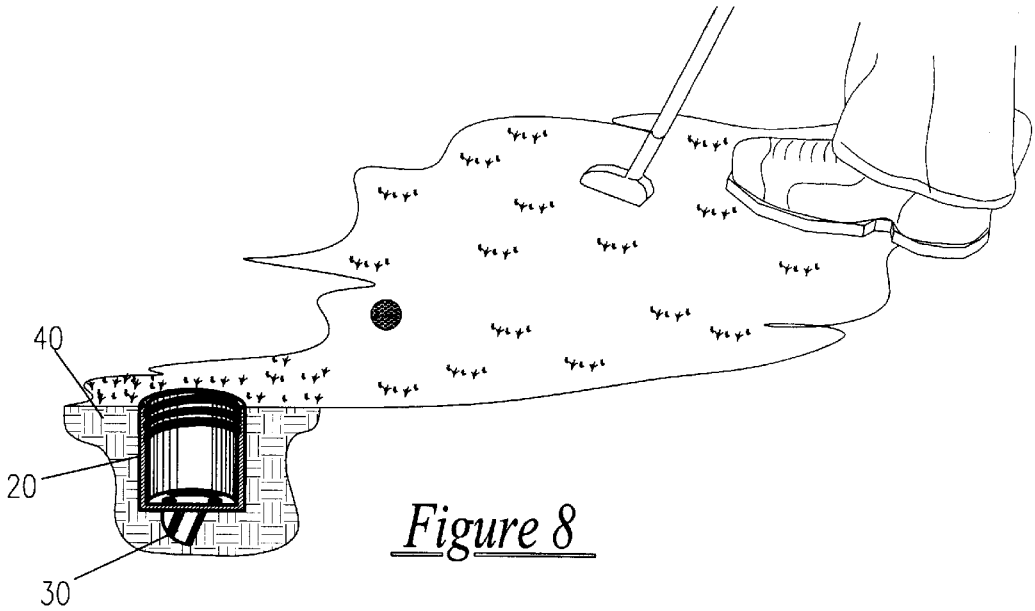
FIG. 8 is an in-use view of the present invention, shown used on a golf green.
Figure 9:
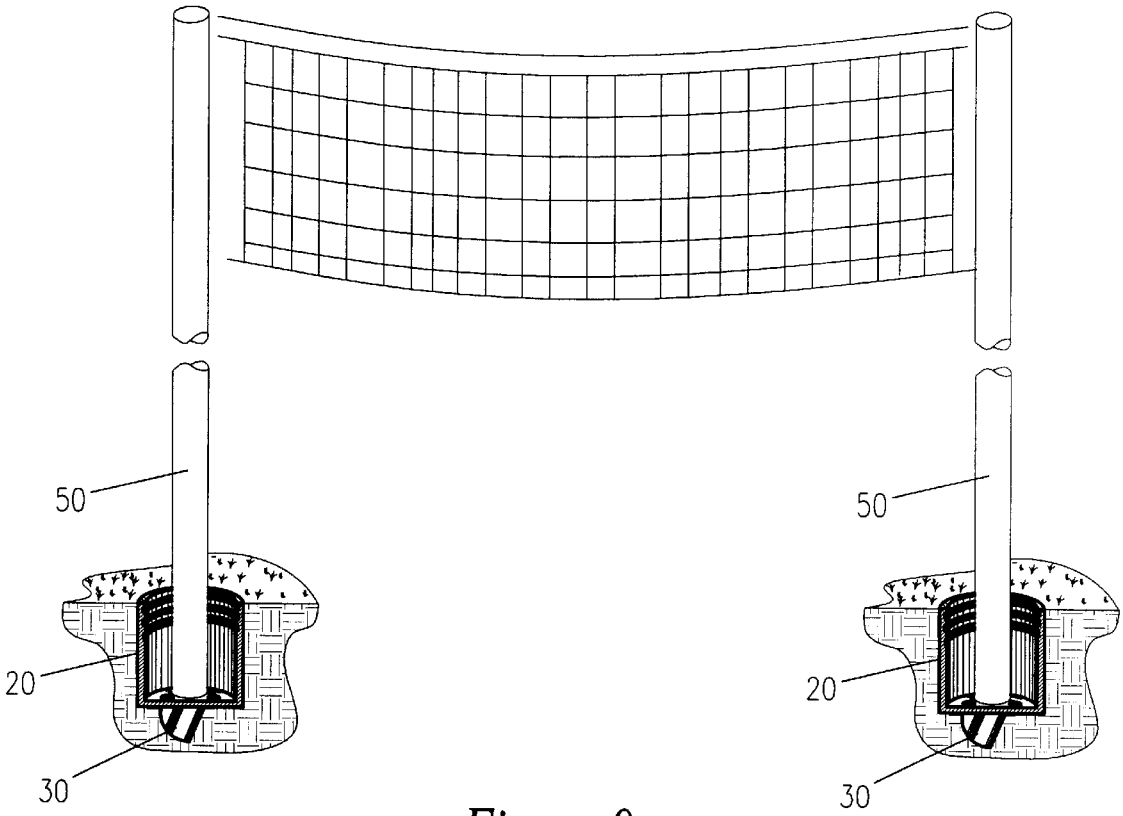
FIG. 9 is an in-use view of the present invention, shown used with sporting equipment.

Referring now to FIGS. 8 and 9, when the insert 20 is desired for use, the cap 60 is screwed off of the insert 20 using the cap rotation means 100.

Figure 10:
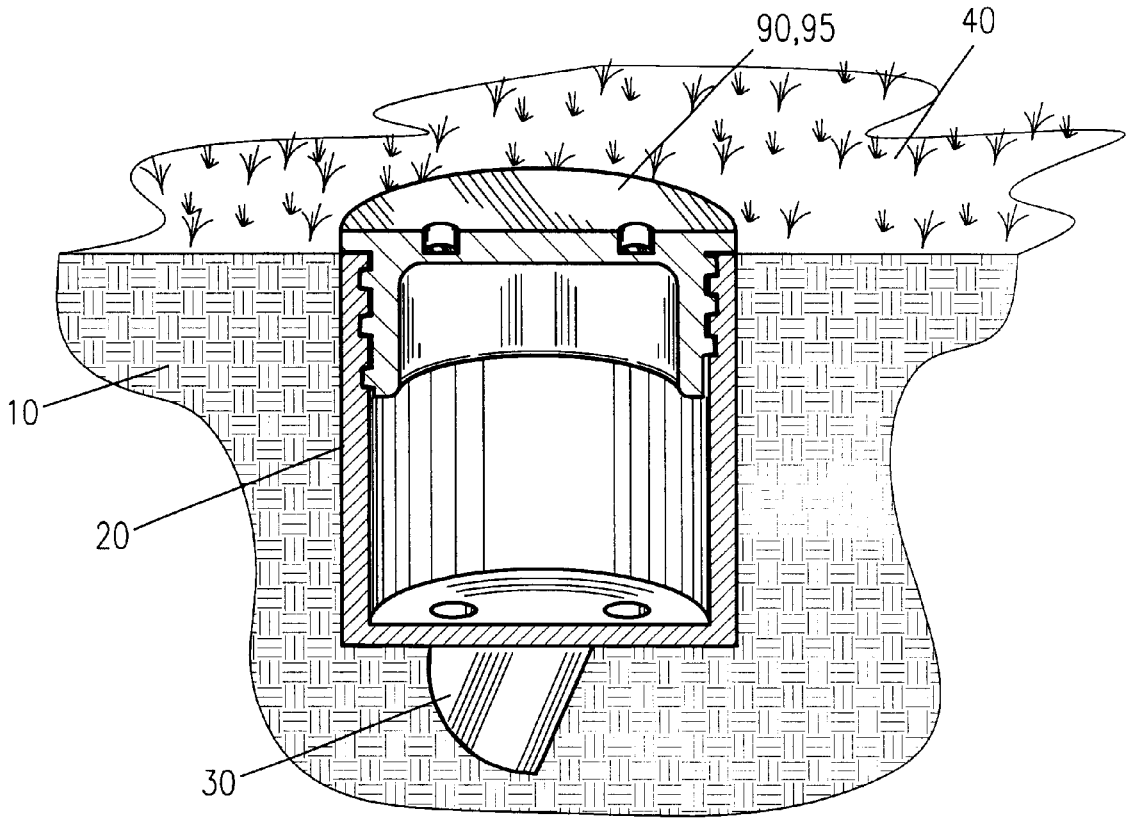
FIG. 10 is a cross-sectional view cut along line XI—XI of FIG. 7, showing the cap in place on the insert.

Referring now to FIG. 10, when the insert 20 is not desired to be used, the cap 60 is screwed on the insert 20 via the cap rotation means 100.

The foregoing description is included to illustrate the operation of the preferred embodiment and is not meant to limit the scope of the invention. The scope of the invention is to be limited only by the following claims.

What is claimed is:

1. An apparatus for the creation and covering of holes on golf greens comprising:

an insert, said insert being of a generally linearly elongated, cylindrical, hollow configuration, with one end of said insert open and the other end generally closed;

internal threads, said internal threads located on the upper, interior circumferential surface of said insert, near the open end of said insert;

a plurality of insert holes, said insert holes located on the generally closed end of said insert and designed to allow water to pass out of the insert;

at least one pointed protrusion, said pointed protrusion being of a generally flat, rectangular configuration, with a knife edge;

a cap, said cap being of a generally flat, round configuration, said cap releasably securing to the top portion of said insert;

external threads said external threads located on said cap's exterior circumferential surface, and designed to mate with said internal threads on said insert; and synthetic grass, said synthetic grass covering the top surface of said cap.

2. The apparatus for the creation and covering of holes on golf greens described in claim 1, wherein said insert is configured so that by removing said cap from said insert, stanchions may be inserted into said insert.

3. The apparatus for the creation and covering of holes on golf greens described in claim 1, wherein said insert is configured so that by removing said cap from said insert, said insert may be used as a traditional golf cup.

4. The apparatus for the creation and covering of holes on golf greens described in claim 1, wherein said apparatus and method for the creation and covering of holes on golf greens and the like further comprises:

cap rotation means, said cap rotation means designed to screw said cap on and off of said insert.

5. The apparatus for the creation and covering of holes on golf greens of claim 4, wherein said cap rotation means is two holes located on the top of said cap designed and located for use with a "T-wrench."

6. The apparatus for the creation and covering of holes on golf greens described in claim 1, wherein said cap is constructed of a material selected from the group comprising rubber, plastic and metal.

7. The apparatus for the creation and covering of holes on golf greens described in claim 1, wherein said insert is constructed of a material selected from the group comprising rubber, plastic and metal.

8. The apparatus for the creation and covering of holes on golf greens described in claim 1, wherein the thickness and density of the synthetic grass is designed to mimic the surrounding surface.

9. The apparatus for the creation and covering of holes on golf greens described in claim 1, wherein said pointed protrusion is designed so as to prohibit the insert from rotating once said insert is placed in the ground.

10. The apparatus for the creation and covering of holes on golf greens described in claim 1, wherein said pointed protrusion is located on the bottom of said insert.

* * * * *